United States Patent [19]

Eng

[11] 4,310,718

[45] Jan. 12, 1982

[54] COAXIAL CABLE FOR HIGH AMPERAGES

[75] Inventor: Kjell Eng, Mullsjö, Sweden

[73] Assignee: AB Volvo, Gothenburg, Sweden

[21] Appl. No.: 104,919

[22] Filed: Dec. 18, 1979

[30] Foreign Application Priority Data

Dec. 21, 1978 [SE] Sweden ..... 7813173

[51] Int. Cl.[3] ..... H01B 7/34

[52] U.S. Cl. ..... 174/15 WF

[58] Field of Search ..... 174/15 C, 15 WF, 28, 174/29, 25 R, 114 S; 219/137.9

[56] References Cited

U.S, PATENT DOCUMENTS

| | | | |
|---|---|---|---|
| 514,925 | 2/1894 | Guilleaume | 174/114 S |
| 2,320,470 | 6/1943 | Rees | 174/15 WF |
| 2,939,902 | 6/1960 | Wreford | 174/15 WF |
| 3,163,704 | 12/1964 | Leathers | 174/15 WF |
| 3,551,581 | 12/1970 | Goodman | 174/15 WF |
| 3,603,715 | 9/1971 | Eilhardt et al. | 174/29 X |
| 3,993,858 | 11/1976 | Sciaky | 174/15 WF |

FOREIGN PATENT DOCUMENTS

| | | | |
|---|---|---|---|
| 311447 | 11/1973 | Austria . | |
| 2341900 | 2/1975 | Fed. Rep. of Germany | 174/15 WF WF |
| 190223 | 6/1964 | Sweden . | |

*Primary Examiner*—Laramie E. Askin

*Attorney, Agent, or Firm*—Young & Thompson

[57] ABSTRACT

In a welding current cable of coaxial type, the conductors for one current direction are arranged essentially parallel to each other and freely movable transversely with respect to each other as a conductor bundle located centrally in the liquid-impermeable cable casing. The central conductor bundle is surrounded at a distance by a textile body, similar to a wrap knit stocking, with annular cross section and running along the length of the cable. The textile body has on its outside radially projecting longitudinal ribs between which the conductors are laid for the opposite current direction. In the spaces between cable casing, conductors and textile body, coolant flows along the length of the cable, and the porous textile body also permits transverse coolant flow.

8 Claims, 3 Drawing Figures

COAXIAL CABLE FOR HIGH AMPERAGES

The present invention relates to a liquid-cooled coaxial cable for high amperages. The requirements placed on such a cable are that it have minimal electrical resistance, that it not be subject to excessive heating during operation, that it be readily flexible and that it be lightweight.

The purpose of the invention is to make available a cable which has these characteristics and which is also inexpensive to manufacture and has a long life. According to the invention, this is achieved with a cable as described hereinafter.

By virtue of the fact that spacer means between the two groups of conductors is made as a single porous warp knit sheath, the spacer means will not stiffen the cable against bending. The spacer means not only permits circulation of the coolant along the length of the cable outside the contours of the spacer but also permits coolant flow within the pores of the spacer, i.e. transversely to the cable. This results in very effective cooling.

Figure 1:
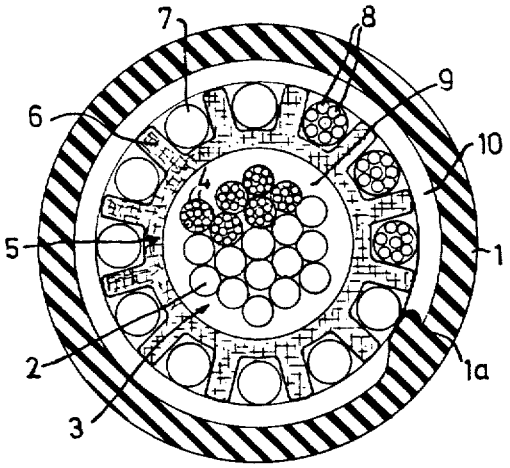
Figure 2:
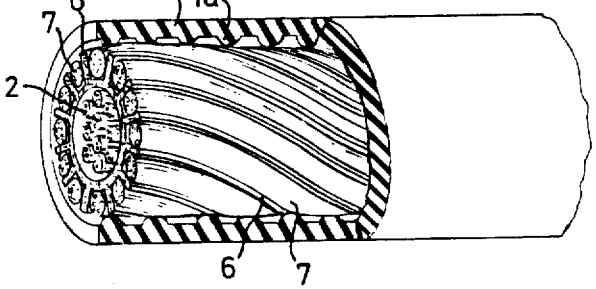
Figure 3:
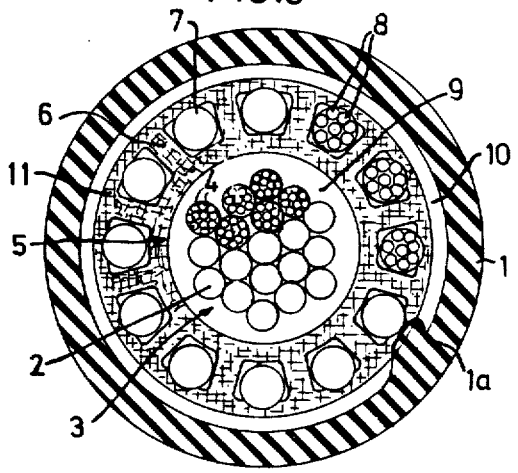

Two embodiments of the invention are described here below in detail with reference to the accompanying drawings, in which FIG. 1 shows a cross section through a coaxial cable according to the invention for a movable welding apparatus, FIG. 2 shows partially cut-away and on a smaller scale a side view of a portion of the cable according to FIG. 1, and FIG. 3 shows a cross section through a second embodiment.

A welding current cable for a movable welder has an outer casing in the form of a flexible hose 1 of a liquid-impermeable, electrically insulating material, for example rubber. Two groups of electrical conductors are arranged within the hose 1, one for each current direction. The first group of conductors 2 is a bundle 3 of conductors 2 in the center of the hose, lying untwined, essentially parallel with each other and thus relatively freely movable laterally in relation to each other. Each conductor 2 consists in turn of twined separate fine copper wires 4.

Radially, at a distance outside the wires 2 in the bundle 3, the bundle is surrounded by a spacer means 5 in the form of a hose-like or sheath-like body with annular cross section and running along the conductor bundle 3 in the longitudinal direction of the hose. The body 5 is porous and is made of porously joined textile material, suitably in the form of a warp knit sheath. The textile body 5 is provided on the outside of its annular portion with radially projecting ribs 6 which extend along the length of the body 5. The ribs 6 have a radial height from the outside of the ring which corresponds to the diameter of the conductors 7 in the second group of conductors. These conductors are placed in the uniformly arranged spaces between the ribs 6. As do the conductors 2, the conductors 7 consist of many twined fine copper wires 8. The ribs 6 and the conductors 7 have a long-pitch helical shape extending longitudinally of the cable. The inside of the hose 1 is made with at least one ridge 1*a* running helically with long pitch. The inner diameter of the hose 1, measured between the inwardly directed top of the ridge 1*a*, is essentially equal to the diameter of the outer edge of the group of conductors 7 and spacer ribs 6, so that the textile body 5 as well as the conductors 7 are centrally fixed in the hose 1.

The conductors 7 conduct current in the opposite direction to the conductors 2 in the central bundle 3. The total cross-sectional area of the conductors 7 should thus be equal to that of the conductors 2. In the example shown, there are more conductors in group 2, but each has a smaller area than the conductors 7. During operation, the conductors 2 must be held separated from the conductors 7, and this is accomplished with the textile body 5 functioning as a spacer. The radially projecting longitudinal ribs 6 of the body 5 also keep the conductors 7 separated from each other. The textile body 5 divides the interior of the hose 1 into two spaces, namely a first space 9 inside the ring of the textile body 5 and a second space 10 outside this ring. The central bundle 3 of conductors is thus situated in space 9. The outer conductors 7 are arranged in space 10 as well as the ribs 6 of the textile body 5, which are located between said conductors 7.

For cooling the conductors 2 and 7, the interior of the hose 1 is filled with coolant such as water, which flows along the length of the hose, on the one hand, in the spaces between the textile body 5 and the conductors 2 and between the conductors 2 themselves, and, on the other hand, in the spaces between the inside of the hose 1 with the ridge 1*a*, the conductors 7 and the contour of the textile body 5 with the ribs 6. Furthermore, the coolant can flow through the textile body 5, both longitudinally and transversely, i.e. radially through the ring of the textile body 5 between the spaces 9 and 10 and peripherally through the ribs 6. The coolant is thus given good possibilities for flowing over the surfaces of the conductors 2,7.

In order to obtain satisfactory cooling, the flow area available to the coolant must not be too small. Thus, for each of the spaces 9 and 10, the ratio between the area available for coolant flow and the total cross-sectional area of the conductors must be greater than 1:2 and preferably 1:1.

During operation, the conductors 2,7 are washed over with coolant and are relatively freely movable transversely inside the ring of the textile body 5 and inside the hose 1, respectively, thus achieving improved liquid cooling. This cooling is improved additionally as a result of the fact that the conductors are caused to move back and forth transversely during operation as a result of the attractive and repulsive forces generated by the welding current pulses. A type of pumping effect is achieved thereby, thus providing adequate cooling even for the conductors 2 in the central bundle 3.

FIG. 3 shows a cross section of a welding cable according to a modified embodiment of the invention. In FIG. 3, parts corresponding to the embodiment of FIG. 2 have the same reference numerals as in FIG. 2. According to FIG. 3, the outer conductors 7 are not freely movable radially outwards into space 10 but are confined adjacent the outer periphery of the ring of the textile sheath 5. In FIG. 3, the conductors 7 are confined by bridges 11 of warp knit spanning the distance between the ribs 6. Alternatively, the ribs 6 may be deleted and the conductors 7 attached to the sheath 5 as by sewing or clamping. With this embodiment, the sheath 5 is also forced to move when the conductors 7 move radially under the influence of the magnetic forces from the current pulses. This action may enhance the above-mentioned pumping effect and improve the cooling.

What I claim is:

1. A liquid-cooled coaxial cable for pulsating high amperage currents, comprising a flexible, electrically insulating, water-impermeable outer casing; two groups of electrical conductors located in said casing, of which a first group of conductors is arranged as a bundle lying centrally in the casing and conducts current of a first polarity, and a second group of conductors is arranged in a ring surrounding the central bundle and conducts current of the opposite polarity; spacer means for maintaining radial distance between the two groups of conductors; there being longitudinal coolant channels for cooling the conductors formed by the interspaces between the conductors, the spacer means and the outer casing; said spacer means comprising a compressible, water-permeable body of textile material, which has an annular cross section; the central opening area within the textile spacer being substantially greater than the total area of the conductors of the first group; the conductors of the first group being arranged loosely and substantially parallel to each other without being attached to each other so as to be freely radially movable within the central spacer body opening; and the annular spacer body having at its outer circumference means for circumferentially separating the conductors of the second group from each other.

2. A cable as claimed in claim 1, in which said circumferentially separating means comprises radial projections formed in one piece with said body and projecting out between the conductors in the second group.

3. A cable as claimed in claim 2, in which said projections are radially projecting longitudinal ribs which extend helically in the longitudinal direction of the textile body.

4. A cable as claimed in claim 1, in which the difference between the outer diameter of the annular portion of the spacer means and the diameter of the interior surface of the casing is substantially greater than the diameter of a conductor of the second group, whereby the conductors of the second group are radially movable.

5. A cable as claimed in claim 1, in which the ratio between the free cross-sectional area available for coolant flow inside the annular textile body and the total cross-sectional area of the central bundle of conductors exceeds 1:2.

6. A cable as claimed in claim 5, in which said ratio is about 1:1.

7. A cable as claimed in claim 1, in which the ratio between the cross-sectional area available for coolant flow outside the annular portion of the textile body, and the total cross-sectional area of the second group of conductors exceeds 1:2.

8. A cable as claimed in claim 7, in which said ratio is about 1:1.

* * * * *